US005534350A

United States Patent [19]

Liou

[11] Patent Number: 5,534,350

[45] Date of Patent: Jul. 9, 1996

[54] POWERFREE GLOVE AND ITS MAKING METHOD

[76] Inventor: Derlin Liou, 4 Fl., No. 293, Sung-Chiang Rd., Taipei, Taiwan

[21] Appl. No.: 365,136

[22] Filed: Dec. 28, 1994

[51] Int. Cl.[6] ..... B32B 27/00

[52] U.S. Cl. ..... 428/423.1; 428/423.9; 2/161.7; 2/168; 264/299

[58] Field of Search ..... 428/423.1, 423.9; 264/299; 2/161.7, 167, 168

[56] References Cited

U.S. PATENT DOCUMENTS 4,855,169 8/1989 McGlothlin et al. ..... 428/423.9

5,272,771 12/1993 Ansell et al. ..... 2/167

5,284,607 2/1994 Chen ..... 264/37

*Primary Examiner*—Mark D. Sweet

*Attorney, Agent, or Firm*—Bacon & Thomas

[57] ABSTRACT

A powderfree glove having an intermediate layer of elastomer made from rubber, an inside water-proof skin contact layer of polyurethane polymer, which permits the glove to be conveniently put on t he hand, and an outside water-proof lubricating layer of polyurethane polymer, which permits the glove to be easily stripped from the ceramic former when the glove is finished.

10 Claims, No Drawings

POWERFREE GLOVE AND ITS MAKING METHOD

BACKGROUND OF THE INVENTION

The present invention relates to gloves, more specifically relates to powderfree medical gloves having the inner and outer sides respectively laminated with a cover layer of polyurethane. The present invention also relates to the method of making the powderfree glove.

Conventional medical gloves are difficult to be put on the hands. Therefore, people tend to spread a lubricating donning powder such as TALC or corn starch over the surface of the gloves so that the gloves can be conveniently put on the hands. However, the powder will contaminate surgical field. Sometimes, the lubricating donning powder with cause an allergy and other side effects. A halogenation treatment may be employed to improve slippery the surface of gloves, enabling the treated gloves to be conveniently put on the hands. However, this treatment wilt result in a poor, aging problem such as brittle and discoloration, U.S. Pat. Nos. 4,143,109; 5,138,719 disclose different structures of gloves that commonly have particles or microcapsules on the inner elastic cover layers, in which particles or microcapsules a lubricating agent is embedded. There are suggestions to laminate the inside of the glove with a cover layer of polymer. For example, U.S. Pat. No. 4,302,852 describes a hypoallergenic surgeon's glove made from a layer of allergic elastomer, such as natural latex, and laminated with a layer of nonallergic elastomer, such as silicone. This structure of glove reduces the need of the lubricating donning powder to one third. U.S. Pat. No. 5,069,965 describes a method of laminating the inside as well outside walls of the glove with a cover layer of vinyl copolymer. Other measures are known in U.S. Pat. Nos. 3,856,561; 4,575,476; 5,272,771. However, these measures still have shortcomings that must be improved.

Conventional medical gloves making methods commonly employ a continuous dipping process to dip with a coagulant before dipping with a latex. The coagulant i s commonly prepared from calcium nitrate or calcium chloride solution. In order to prevent the adhesion of rubber to the former, a release powder, such as calcium carbonate, or a stripping agent, such as glycerin or fatty acid, is commonly used. However, the application of the release powder or stripping agent will contaminate the former. Therefore, the former must be washed after each production cycle. Another method for removing the glove from former is to be accomplished by stripping glove under warm water, the inconvenience that further required tumblering glove with lubrications and the final drying process. There is a suggestion to dip the former with an emulsion type polymer before the application of the coagulant. Because the coagulant is an eletrolytic dispersion, the problem of gelling or sediment will occur when the coagulant is mixed with an emulsify type polymer. Therefore, the coagulant can only employed only when the polymer is dried. This limitation complicates the production process of the glove. Furthermore, when the aforesaid polymer is used for making the inside cover layer of a glove, it must be employed when the rubber of the glove is gelled. If the solvent concentration of the polymer emulsion is excessively high, the manufacturing cost of the glove will be relatively increased, and an environment al pollution will happen.

In comparison with conventional glove production methods, the advantages of the present invention are apparent.

| STEP | DESCRIPTION |
|---|---|
| I. | Dipping former with acid/detergent |
| II. | Cleaning former with brush/water |
| III. | Drying |
| IV. | Dipping with coagulant |
| V. | Dipping with latex |
| VI. | Leaching |
| VII. | Dipping with polymer |
| VIII. | Dipping with powder/silicone |
| IX. | Vulcanization |
| X. | Cooling |
| XI. | Dipping with water |
| XII. | Stripping |
| XIII. | Chlorination |
| XIV. | Neutralization |
| XV. | Washing out powder |
| XVI. | Tumblering with lubrications |

Powdered gloves:

The method of making a powdered glove needs 12 steps and takes about 30–35 minutes, which 12 steps are as follows: STEP I→STEP II→STEP III→STEP IV→STEP III→STEP V→STEP III→STEP VI→STEP VIII→STEP IX→STEP X→STEP XII→.

Chlorinated powderfree gloves:

The method of making a chlorinated powderfree glove needs 13 steps if water type stripping is employed, or 17 steps if dry type stripping is employed, and takes about 2–3 hours. Water type stripping: STEP IV→STEP III→STEP V→STEP III→STEP IV→STEP VIII→STEP IX→STEP XI→STEP XII→STEP XIII→STEP XIV→STEP VI→STEP III. Dry type stripping: STEP I→STEP II→STEP III →STEP IV→STEP III→STEP V→STEP III →STEP VI→STEP VIII→STEP IX—D >STEP X →STEP XII→ STEP XV→STEP XIII→STEP XIV →STEP VI→STEP III.

Single polymer coating powderfree gloves:

The method of making a single polymer coating powderfree glove needs 12 steps if water type stripping is employed, or 16 steps if dry type stripping is employed, and takes about 1–2 hours. Water type stripping: STEP→STEP III→STEP V→STEP III→STEP VI→STEP III→STEP VII→STEP IX→STEP X→STEP XII→STEP XV →STEP→XVI→STEP III. Dry type stripping: STEP I→STEP II→STEP III →STEP IV→STEP III→STEP V→STEP III→STEP VI→STEP III→STEP VII→STEP IX→STEP X→STEP XII→STEP XV→STEP XVI→STEP III.

Powderfree gloves of the present invention:

The method of making a powderfree glove according to the present invention needs 8 steps and takes about 30 minutes only, which 8 steps includes: STEP IV→STEP III→STEP V→STEP III→STEP VII→STEP IX→STEP X→STEP XII.

A powderfree glove according to the present invention comprises a intermediate layer of elastomer made from natural or synthetic rubber, and a laminate layer covered on both sides of the intermediate layer. The laminate layer is mainly made from aliphatic polyurethane (the contents of ingredients hereinafter described are calculated by weight) through a solution polymerization method. The aliphatic polyurethane is made into an aqeous disperion containing 30–40% so solid matter without having organic cosolvent. The elongation of aliphatie polyurethane layer is better above 350%, more prefer over 500%, Sward hardness is prefer under 15, so as to avoid from affecting the flexibility and softness of the glove, and to prevent the laminate layer from breaking down due to the stretch of glove, the difference of elongation and tensile strength between the rubber and the laminate layer. A glove made according to the present invention, the laminate layer is abrasion resistant and water proof, therefore the glove surface will not be rubbed off by wet operation or long period abrasion.

During the production, the former is coated with a layer of aliphatic polyurethane, which is prepared in the form of an aqeous dispersion. The aliphatic polyurethane can be simultaneously used with the coagulant, or separately used before the application of the coagulant. The solid content of the aliphatic polyurethane is about 1% –6%, or preferably within 2% –4%. When the aliphatic polyurethane is separately used, it must be well dried and then dipped with a coagulant. If the aliphatic polyurethane is used with a coagulant, it must be first mixed with a non-ionic stabilizer so that the aliphatic polyurethane can be maintained stable when the coagulant is added. Non-ionic surfactant of high molecular number, such as alkyl phenol ethylene oxide can be used as a non-ionic stabilizer. The amount of the non-ionic stabilizer relative to the solid content of the aliphatic polyurethane is about 0.5% –5%. This non-ionic stabilizer provides a satisfactory mechanical stability to the coagulant, without affecting the properties of the coagulant and the rubber. A small amount of surfactant can be selectively added. For example, polypropylene glycol ethoxylate, octylphenol ethoxylate, or alcohol ethoxylate provides a satisfactory wetting effect. The applicable amount of the surfactant is about 0.01% to 0.25% by weight. A small amount of silicone emulsion of about 0.01% to 0. 1% by weight may be added to improve the stripping effect of the glove from the former.

The coagulant can be prepared from calcium nitrate or calcium chloride solution for the advantage of low cost. The amount of the coagulant is about 8–15% by weight and adjusted subject to the thickness and dipping time of the glove to be made. After the coagulant is dried, the former is dipped with a latex, which can be prepared according to conventional methods. The solid content of the latex i s about 30–45% by weight and adjusted subject to the thickness and dipping time of the glove to be made. After the former is dipped with rubber, it is slightly heated to dry, and then treated through a leaching process to remove water soluble chemicals and allergens from rubber.

The leaching process may be omitted. Because the intermediate rubber layer is covered within the aliphatic polyurethane, water molecules cannot penetrate through the aliphatic polyurethane to carry water soluble chemicals and protein out of the glove. We made a study to compare the difference of the extraction content of glove which receive leaching and without leaching process as follows: Group A: powdered glove without leaching process.

Group B: powdered glove with leaching process.

Group C: powderfree glove without leaching process.

Group D: powderfree glove with leaching process.

Group A and D were leached in 75° C. of water for 5 minutes. 10 pieces glove of each group were made, each glove was extracted by 40° C. of water for 3 hours. Comparing the volume of extracted water soluble chemicals and protein content of each glove, we found that if group A was 100, group B was 75, group C was 5, group D was 2, and there were little difference of physical properties between group C and D.

According to another aspect of the present invention, the gloves are Hypoallergenic. Because the rubber gloves of the present invention are respectively covered within waterproof polyurethane. This polyurethane cover layer prevents a direct contact between the skin and the rubber. Because the polyurethane proof, it isolates the contents of water soluble chemical s and protein of from being dissolved by water.

The materials for the second lubricating polyurethane layer are similar to that for the first lubricating polyurethane layer. However, silicon emulsion is added for making the second lubricating polyurethane layer. The solid content of the second lubricating polyurethane layer is about 3–10% or preferably about 4–6%. The content of silicon emulsion is about 0.5–2% by weight. The use of silicon emulsion greatly enables the gloves to be slipped on wet hands. Silicon emulsion and polyurethane may be separately employed. The former may be dipped with polyurethane and then dipped with silicon emulsion 0.05–0.5% by weight after polyurethane is dried. After dipping, the former with rubber polyurethane are heated at 110° C. for about 15–20 minutes to let rubber be vulcanized and polyurethane be cured. After heating, the former is slightly cooled down, then the glove is removed from the former and turned inside-out to let the first layer of polyurethane be the outside layer of the glove and the second layer of polyurethane be the inside layer of the glove. A glove made according to the aforesaid procedure needs not to be dipped with warm water or treated through the process of tumblering with lubrications, and the former is maintained clean after the production of the glove. After the production, the gloves has a dry and smooth surface. The inside layer of the glove is slippery on a wet hand, therefore the glove can be easily put on or taken out of the hand. The outside layer of the glove is not adherent, and the inside layer of the glove more slippery than the outside layer.

The method of making gloves according to the present invention includes the steps of:

Step I: to dip the ceramic former with a coagulant dispersion, which contains a polyurethane polymer;

Step II: to dip the ceramic former with latex after the coated coagulant layer has been dried;

Step III: to dip the ceramic former with aliphatic polyurethane after the coated latex layer has been dried;

Step IV: to cure polyurethane and simultaneously to vulcanize rubber; and

Step V: to strip the finished glove from the ceramic former after it is slightly cooled down.

EXAMPLE I

A ceramic bisque former is heated to 40–50×C and then dipped into a 35–45×C coagulant dispersion for about 5–10 seconds, which coagulant dispersion contains:

| | |
|---|---|
| Calcium Nitrate | 12% |
| PU dispersion | 5% |
| Stabilizer | 0.01% |
| Silicone emulsion | 0.03% |

wherein PU dispersion contains 40% solid matter of linear aliphatic polyether urethane; stabilizer is a nonionic high molecular surfactant; silicone emulsion contains 35% dimethysiloxane polymer. After dipping with the coagulant dispersion, the ceramic former is slowly pulled out of the coagulant dispersion and then rotated to let the coagulant dispersion be uniformly distributed over the surface of the ceramic former. The ceramic former is than moved to an oven and heated at 90° C. for about 75 seconds. After drying, the ceramic former is dipped into a latex emulsion for about 10–20 seconds, which latex emulsion contains 36% of dry rubber and is maintained at 25° C. After dipping with the latex emulsion, the ceramic former is turned and lifted, and then the ceramic former is heat ed in an oven at 90° C. for about 60 seconds. After heating, the ceramic former is dipped into a dispersion of 40° C. for about 10–20 seconds, which dispersion contains:

| | |
|---|---|
| Polyurethane dispersion | 10% |
| Silicone emulsion | 1.5% |
| Surfactant | 0.5% |

wherein the polyurethane dispersion and the silicone emulsion are of same composition as that used in the aforesaid coagulant dispersion; the surfactant is a nonionic surfactant of trademark "Terric X-100" which can be conveniently obtained from the market. After dipping with the polyurethane dispersion, the ceramic former is then dried at 110–130° C. for about 15–20 minutes. After drying, the ceramic former is fan cooled, and then the glove is removed from the ceramic former. After the production, the ceramic former can be used for a next production cycle without washing.

EXAMPLE II

The material preparation and the production procedure are similar to that described in EXAMPLE I, except the additional step of dipping the ceramic former into 70°–80° C. hot water for about 5 minutes before the step of dipping with the polyurethane dispersion and after the step of dipping with the latex emulsion. A glove of EXAMPLE II and a glove of EXAMPLE I are similar in physical properties, and show little difference when extracted by water.

EXAMPLE III

The material preparation and the production procedure are similar to that described in EXAMPLE I, except the additive of polypropylene glycol ethoxylate, which is added to the polyurethane dispersion. The content of polypropylene glycol ethoxylate is 0.5% by weight. This item can be conveniently obtained from the market, for example, the trademark name "Terric PE 78". When this additive is used, the brightness of the surface of the glove is relatively improved, however the slippery status of the glove is maintained unchanged.

EXAMPLE IV

The material preparation and the production procedure are similar to that described in EXAMPLE I, however the aforesaid linear aliphatic polyether urethane is replaced by aliphatic polyester urethane, for example: by "NeoRez R-976". Same satisfactory result can be achieved when aliphatic polyester urethane is used.

EXAMPLE V

A ceramic bisque former is heated to 40°–50° C. and then dipped into a 40° C. polyurethane dispersion for about 10 seconds, which polyurethane dispersion contains: 6% by weight of NeoRez R-976, 0.025% by weight of silicone emulsion such as "PA-65", and 0.2% by weight of surfactant. After dipping, the ceramic former is heated at 90° C. for about 90 seconds. After drying, the ceramic former is dipped into a dispersion containing 10% by weight of calcium nitrate, and then the ceramic former is heated at 90° C. for about 75 seconds. After heating, the ceramic former is dipped into a latex emulsion for about 10–20 seconds, which latex emulsion contains 36% of sol id matter and is maintained at 25° C. After dipping with the latex emulsion, the ceramic former is heated in an oven at 90° C. for about 60 seconds. After heating, the ceramic former is dipped into a 40° C. dispersion for about 10–20 seconds, which dispersion contains NeoRez R-976 10% by weight and Terri c X-100 0.05% by weight. After dipping with the polyurethane dispersion, the ceramic former is heated at 90x for about 60 seconds, and then dipped into a dispersion containing PA-65 0.25% by weight, and they dried at 110–130° C. for about 20 minutes. After heating, the ceramic former is fan cooled, and then the glove is removed from the ceramic former. After the production, the ceramic former can be used for a next production cycle without washing. The inside layer of a glove of EXAMPLE V is more slippery than that of EXAMPLE IV within 20 days after the production. However, it shows little difference when 20 days passed. The possible reason of this result is that silicone has been almost fully absorbed by polyurethane after 20 days from the production.

I claim:

1. A glove making method for making gloves which are powder-free consisting essentially of the steps of:

i: dipping a ceramic former into a powder free coagulant dispersion, which contains a polyurethane polymer, then removing said ceramic former from said coagulant dispersion and drying it to form a first lubricating layer on said ceramic former;

ii: dipping said first lubricating layer into a latex emulsion and then drying it so as to form an intermediate layer of elastomer on said ceramic former over said first lubricating layer;

iii: dipping said layer of elastomer into a polyurethane solution containing a silicone emulsion and then drying it so as to form a second lubricating layer on said intermediate layer of elastomer;

iv: putting said ceramic former with said first and second lubricating layers and said intermediate layer of elastomer into an approximately 110° C. vulcanizing oven, permitting said intermediate layer of elastomer to be vulcanized and said first and second lubricating layers to be cured; and v: cooling the cured first and second lubricating layers and vulcanized intermediate layer of elastomer, and then removing the powder-free glove from said ceramic former.

2. The glove making method of claim 1 wherein said coagulant dispersion contains solid polyurethane at least 1–5% by weight, and nonionic stabilizer 0.005–0.1% by weight.

3. The glove making method of claim 1 wherein said coagulant dispersion contains solid polyurethane in the amount of at least 2–8% by weight.

4. The glove making method of claim 4 wherein said step ii includes the procedure of dipping said first lubricating layer and said intermediate layer of elastomer into hot water to remove water soluble chemicals and allergens from said intermediate layer of elastomer.

5. The glove making method of claim 1 wherein in step i the coagulant dispersion contains silicone emulsion in the amount of 0.01–0.1% by weight of the coagulant dispersion.

6. The glove making method of claim 1 wherein in step i the polyurethane polymer is linear aliphatic polyether urethane.

7. The glove making method of claim 1 wherein in step i the polyurethane polymer is linear aliphatic polyester urethane.

8. The glove making method of claim 1 wherein in step iii the silicone emulsion is present in the amount of 0.5 to 2% by weight of the polyurethane solution.

9. The glove making method of claim 1 wherein in step i the coagulant dispersion comprises about 12% calcium nitrate, about 5% polyurethane dispersion, about 0.01% stabilizer and about 0.03% silicone emulsion.

10. The glove making method of claim 1 wherein in step iii the polyurethane solution comprises about 10% polyurethane dispersion, about 1.5% silicone emulsion and about 0.5% surfactant.

* * * * *